US008403682B2

(12) United States Patent
Motoda

(10) Patent No.: US 8,403,682 B2
(45) Date of Patent: Mar. 26, 2013

(54) ELECTRONIC CONTROL DEVICE

(75) Inventor: Haruaki Motoda, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 13/231,359

(22) Filed: Sep. 13, 2011

(65) Prior Publication Data

US 2012/0071010 A1 Mar. 22, 2012

(30) Foreign Application Priority Data

Sep. 22, 2010 (JP) ..... 2010-211979

(51) Int. Cl.
*H01R 12/00* (2006.01)

(52) U.S. Cl. ..... 439/74

(58) Field of Classification Search ..... 439/74, 439/75; 361/804, 758, 742; 174/138 G, 174/138 D See application file for complete search history.

(56) References Cited

U.S. PATENT DOCUMENTS

| | | | | | |
|---|---|---|---|---|---|
| 3,668,476 | A | * | 6/1972 | Wrabel et al. | 361/785 |
| 3,904,934 | A | | 9/1975 | Martin | |
| 4,200,900 | A | * | 4/1980 | McGeorge | 361/803 |
| 4,331,370 | A | * | 5/1982 | Andrews et al. | 439/75 |
| 4,556,266 | A | * | 12/1985 | Sonobe | 439/505 |
| 4,664,458 | A | * | 5/1987 | Worth | 439/82 |
| 4,738,024 | A | * | 4/1988 | Eberhardt | 29/830 |
| 5,345,366 | A | * | 9/1994 | Cheng et al. | 361/785 |
| 5,478,248 | A | * | 12/1995 | Mitra et al. | 439/74 |
| 5,567,167 | A | * | 10/1996 | Hayashi | 439/75 |
| 5,634,810 | A | * | 6/1997 | Niitsu et al. | 439/378 |
| 5,825,633 | A | * | 10/1998 | Bujalski et al. | 361/804 |
| 6,191,954 | B1 | * | 2/2001 | Keidl et al. | 361/803 |
| 6,503,090 | B2 | * | 1/2003 | Onizuka | 439/75 |
| 8,199,520 | B2 | | 6/2012 | Kishino et al. | |

FOREIGN PATENT DOCUMENTS

| | | | |
|---|---|---|---|
| JP | 2003-61225 | A | 2/2003 |
| JP | 2006-287101 | A | 10/2006 |
| JP | 2010-35304 | A | 2/2010 |
| JP | 2010-97759 | A | 4/2010 |
| JP | 2010-111248 | A | 5/2010 |

OTHER PUBLICATIONS

Japanese Office Action dated Jul. 31, 2012 (two (2) pages).

* cited by examiner

*Primary Examiner* — Phuong Dinh
(74) *Attorney, Agent, or Firm* — Crowell & Moring LLP

(57) ABSTRACT

An electronic control device including a plurality of terminal pins each including a first circuit board side connecting portion connected to a first circuit board, a second circuit board side connecting portion connected to a second circuit board, and an intermediate connecting portion disposed between the first and second circuit board side connecting portions and extending in an overlapping direction in which the first and second circuit boards overlap with each other, the intermediate connecting portions being aligned in a row along a predetermined alignment direction, and the terminal pins at least partially including adjacent two terminal pins formed into a bent shape such that the first circuit board side connecting portion of one of the adjacent two terminal pins is offset relative to the first circuit board side connecting portion of the other adjacent two terminal pins in a direction perpendicular to the predetermined alignment direction.

9 Claims, 11 Drawing Sheets

ELECTRONIC CONTROL DEVICE

BACKGROUND OF THE INVENTION

The present invention relates to an electronic control device including a first circuit board and a second circuit board electrically connected with each other through a plurality of terminal pins.

Japanese Patent Application Unexamined Publication No. 2010-111248 discloses a control unit (i.e., an electronic control device) for an electronic power steering which includes a power board as a first circuit board for driving a steering assist electric motor, and a control board as a second circuit board for outputting a drive command to the power board, the power board and the control board being electrically connected with each other through a plurality of connecting terminals formed as terminal pins. Further, the connecting terminals are arranged in a row on the power board in view of an operating efficiency of mounting the connecting terminals onto the power board.

SUMMARY OF THE INVENTION

In a case where the connecting terminals are arranged in a row on the power board as described in the above conventional art, it is preferred that an interval between the connecting terminals is reduced in view of downsizing the control unit. However, in view of the fabricating method, it is necessary that lands to be formed on the power board are provided at certain intervals therebetween in order to connect the connecting terminals with each other. Accordingly, there occurs such a problem that as the number of the connecting terminals is increased, the control unit becomes larger in size.

It is an object of the present invention to provide an electronic control device that is prevented from being upsized due to the increase in the number of the connecting terminals that connect the first circuit board and the second circuit board with each other.

In one aspect of the present invention, there is provided an electronic control device including:

a first circuit board;

a second circuit board overlapping with the first circuit board with a space therebetween; and a plurality of terminal pins through which the first circuit board and the second circuit board are electrically connected with each other;

wherein each of the plurality of terminal pins includes a first circuit board side connecting portion connected to the first circuit board, a second circuit board side connecting portion connected to the second circuit board, and an intermediate connecting portion disposed between the first circuit board side connecting portion and the second circuit board side connecting portion, the intermediate connecting portion extending in an overlapping direction in which the first circuit board and the second circuit board overlap with each other, the intermediate connecting portions of the plurality of terminal pins are disposed between the first circuit board and the second circuit board and aligned in a row along a predetermined alignment direction, and the plurality of terminal pins at least partially include adjacent two terminal pins which are formed into a bent shape such that the first circuit board side connecting portion of one of the adjacent two terminal pins is offset relative to the first circuit board side connecting portion of the other of the adjacent two terminal pins in a direction perpendicular to the predetermined alignment direction.

According to the present invention, the following effect can be attained. Adjacent connecting terminal pins that connect first and second circuit boards with each other of an electronic control device can be arranged at reduced intervals therebetween. As a result, the electronic control device can be prevented from being upsized due to an increase in number of the connecting terminal pins.

Other objects and features of this invention will become understood from the following description with reference to the accompanying drawings.

DETAILED DESCRIPTION OF THE INVENTION

Figure 1:
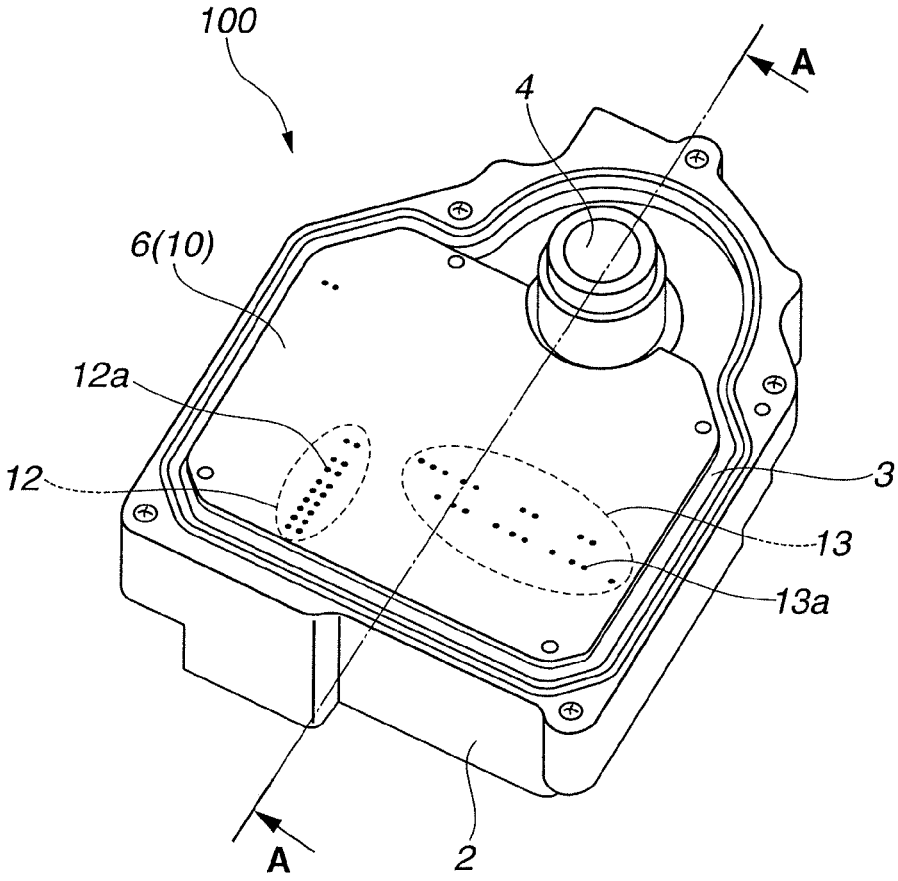
FIG. 1 is a perspective view of an electronic control device according to a first embodiment of the present invention, in which a cover of the electronic control device is taken off.
Figure 2:
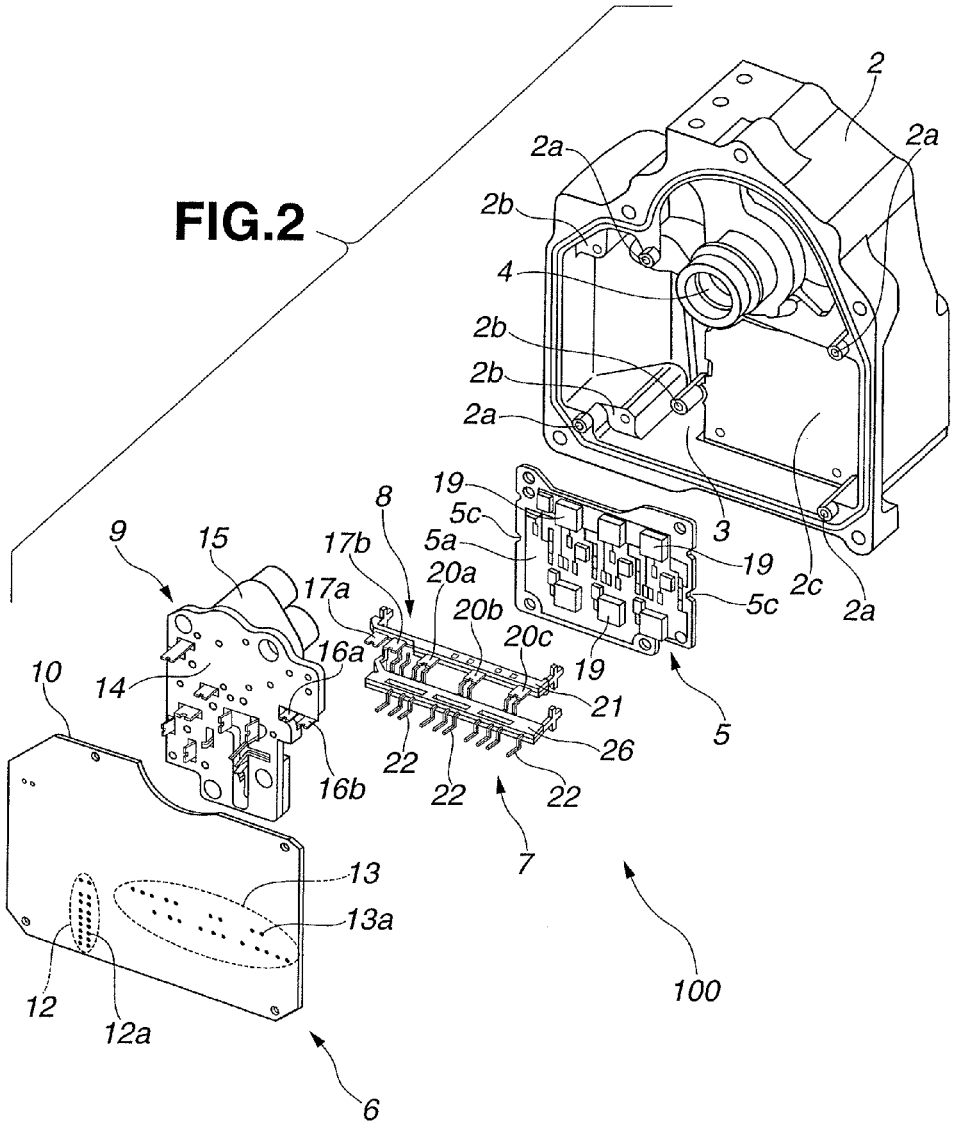
FIG. 2 is an exploded perspective view of the electronic control device shown in FIG. 1.
Figure 3:
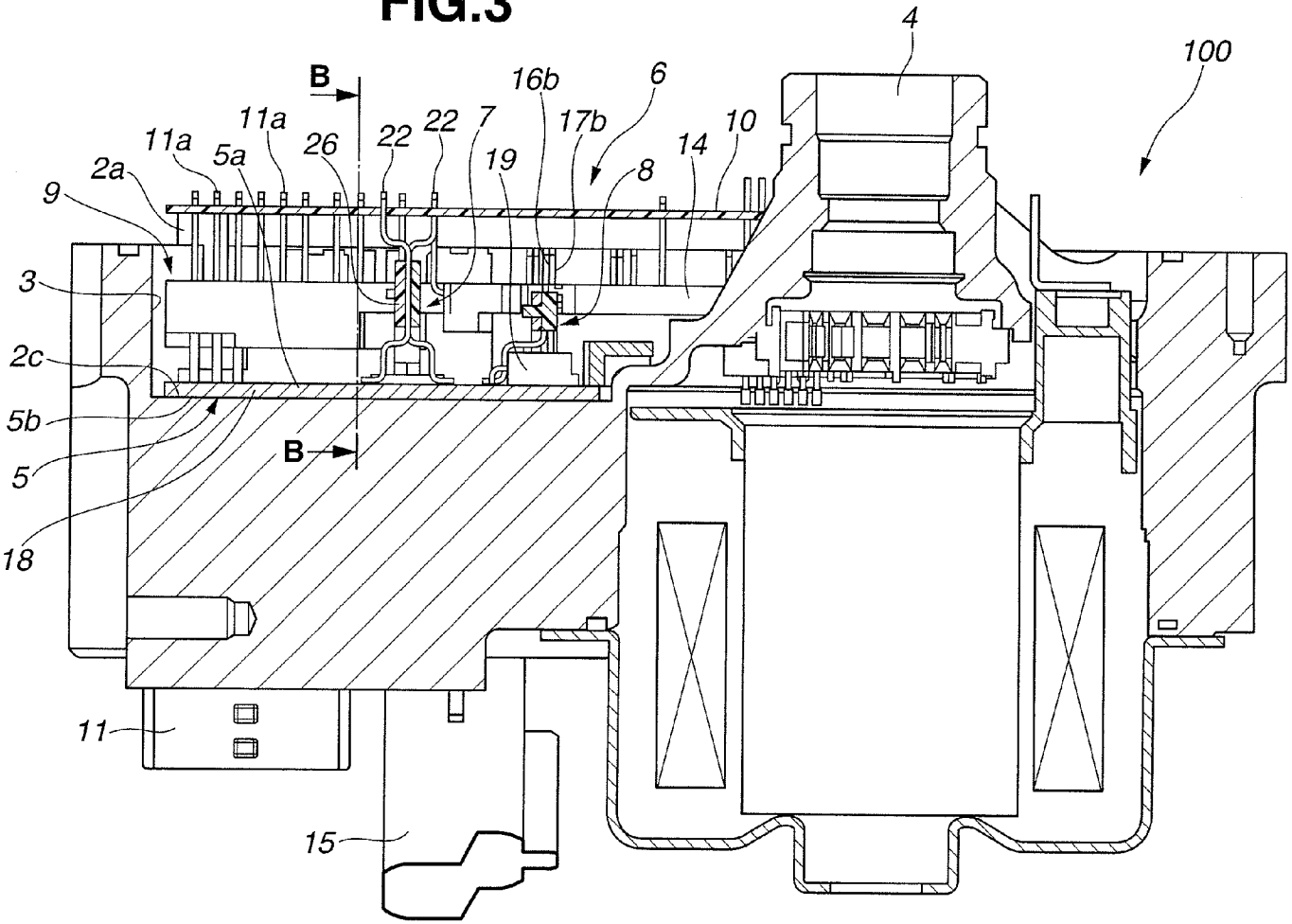
FIG. 3 is a cross section of the electronic control device, taken along line A-A shown in FIG. 1.

Referring to FIG. 1 to FIG. 8, there is shown an electronic control device according to a first embodiment of the present invention, which is usable in a hydraulic power steering device for an automobile. FIG. 1 is a perspective view of the electronic control device according to the first embodiment, in which a cover is taken off. FIG. 2 is an exploded perspective view of the electronic control device shown in FIG. 1. FIG. 3 is a cross section of the electronic control device, taken along line A-A shown in FIG. 1.

As shown in FIGS. 1-3, electronic control device 100 that drives and controls an electric motor for driving an oil pump in a hydraulic power steering apparatus, includes housing 2 formed with circuit board accommodating recessed portion 3, power module 5 as a first circuit board disposed in circuit board accommodating recessed portion 3, and control module 6 as a second circuit board overlapping with power module 5 with a given space therebetween. Thus, electronic control device 100 has a stack construction. Housing 2 is made of a metal material, for instance, aluminum alloy, which has an excellent thermal conductivity. Power module 5 serves for generating three-phase alternating current for driving an electric motor (not shown). Control module 6 controls a plurality of switching elements 19 mounted on power module 5 as explained later. Power module 5 and control module 6 are electrically connected with each other through signal-system lead frame 7. Power module 5 and a battery (not shown) as a direct-current power source are electrically connected with each other through power-system lead frame 8 and conductive module 9. Housing 2 is common to an electric motor (not shown), and formed with drive shaft insertion hole 4 that extends through housing 2 and receives a motor drive shaft.

Control module 6 includes resin plate 10 that is made of a non-conductive resin material, for instance, a glass-epoxy resin and has a conductive pattern (not shown) on upper-side and lower-side surfaces thereof. A plurality of electronic parts (not shown) are mounted on the upper-side and lower-side surfaces of resin plate 10. Control module 6 is secured to control module mounting portion 2*a* of housing 2 which outwardly projects beyond an open end surface of circuit board accommodating recessed portion 3, by means of screws (not shown). Meanwhile, control module 6 is accommodated in a cover (not shown) that covers circuit board accommodating recessed portion 3 of housing 2.

Further, control module 6 is connected to an on-board network such as CAN through signal connector 11 shown in FIG. 3, and performs data transmitting/receiving between control module 6 and control devices of respective parts of the vehicle body. Control module 6 calculates steering assist force to be generated by the electric motor, on the basis of vehicle driver's steering torque, vehicle speed, etc. and transmits control signals to switching elements 19 mounted on power module 5 through signal-system lead frame 7. Control module 6 thus allows switching elements 19 to conduct desired switching operation, and controls rotational speed, driving torque, etc. of the electric motor. In FIGS. 1 and 2, reference numeral 12 denotes a connecting portion having a plurality of through-holes 12*a* for connecting with terminals 11*a* of signal connector 11. In FIGS. 1 and 2, reference numeral 13 denotes a signal-system lead frame connecting portion having a plurality of through-holes 13*a* for connecting with signal-system terminal pins 22 of signal-system lead frame 7.

Conductive module 9 shown in FIGS. 2 and 3 includes a plate-shaped base 14 and a plurality of busbars as power lines which are embedded in plate-shaped base 14. Plate-shaped base 14 is a molded product made of a non-conductive resin material which is integrally formed with power source connector 15 to which the battery is connected. The busbars are formed by pressing a copper plate. Conductive module 9 is secured to conductive module mounting portions 2*b* of housing 2 by means of screws (not shown). Each of conductive module mounting portions 2*b* projects from a bottom of circuit board accommodating recessed portion 3, and has an upper end located at a level between power module 5 and control module 6. Further, conductive module 9 includes a pair of power supply terminals 16*a*, 16*b* welded to a pair of power source terminal pins 17*a*, 17*b* of power-system lead frame 8, respectively. Thus, direct current in the battery (not shown) can be supplied to power module 5.

Power-system lead frame 8 shown in FIGS. 2 and 3 is formed by pressing a conductive metal plate such as a copper plate. Power-system lead frame 8 includes the pair of power source terminal pins 17*a*, 17*b* respectively welded to power supply terminals 16*a*, 16*b* of conductive module 9, three motor connecting terminal pins 20*a*, 20*b*, 20*c* respectively connected to three-phase coils (i.e., a U-phase coil, a V-phase coil and a W-phase coil) of a steering assist electric motor (not shown), and power terminal pin holder 21 fixed to power module 5 and holding a row of terminal pins 17*a*, 17*b*, 20*a*, 20*b*, 20*c* in an aligned manner.

As shown in FIGS. 2 and 3, power module 5 is equipped with the plurality of switching elements 19 each being a heating element having a relatively large heat value. Therefore, from the viewpoint of heat radiation, power module 5 uses metal plate 18 as a base made of a metal material (for instance, aluminum alloy) that has a relatively good thermal conductivity. Power module 5 has one surface as part mounting surface 5*a* that has a conductive pattern through an insulating layer formed on one surface of metal plate 18. Electronic parts including the plurality of switching elements 19 are mounted on part mounting surface 5*a*. In this embodiment, a MOSFET (field-effect transistor) is used as respective switching elements 19.

Respective switching elements 19 conduct the switching operation on the basis of the control signals from control module 6, thereby converting the direct current of the battery (not shown) to the three-phase alternating current and supplying the three-phase alternating current to the electric motor (not shown) through power-system lead frame 8. Since a relatively large amount of current flows in power module 5, the conductive pattern of power module 5 is formed of a metal foil having a thickness larger than that of a metal foil for the conductive pattern of control module 6.

The other surface of power module 5 which is located on the opposite side of part mounting surface 5*a* serves as cooling surface 5*b* which is an exposed surface of metal plate 18. Power module 5 is fixed to housing 2 by means of screws (not shown) in such a state that cooling surface 5*b* is placed on flat power module mounting surface 2*c* formed at the bottom of circuit board accommodating recessed portion 3 of housing 2. Further, heat conductive grease (not shown) is disposed between power module mounting surface 2*c* of housing 2 and cooling surface 5*b* of power module 5, such that the heat generated from respective switching elements 19 is radiated via the heat conductive grease and housing 2.

Figure 4:
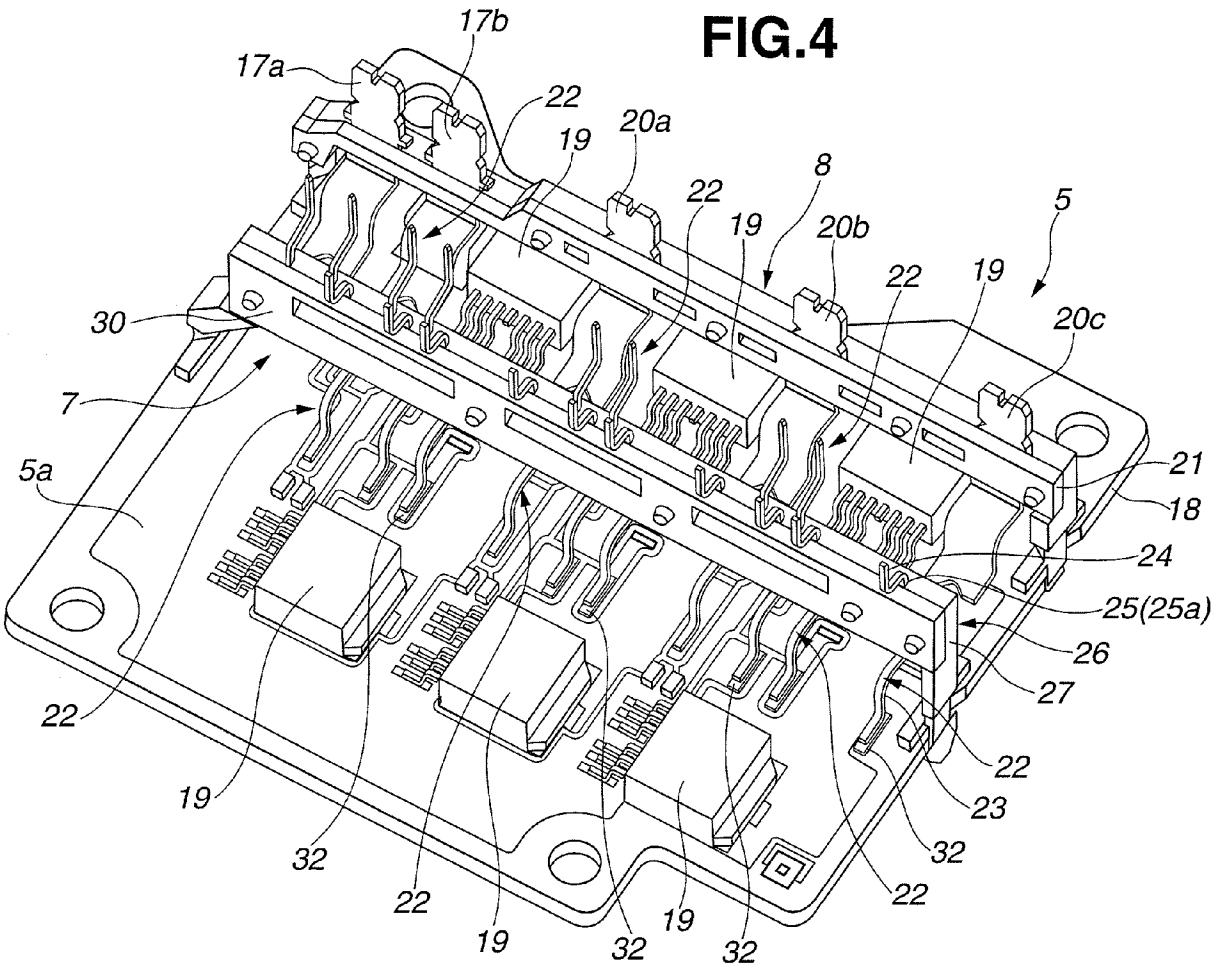
FIG. 4 is a perspective view of a power module of the electronic control device as shown in FIG. 2 to which a power-system lead frame and a signal-system lead frame are mounted.
Figure 5:
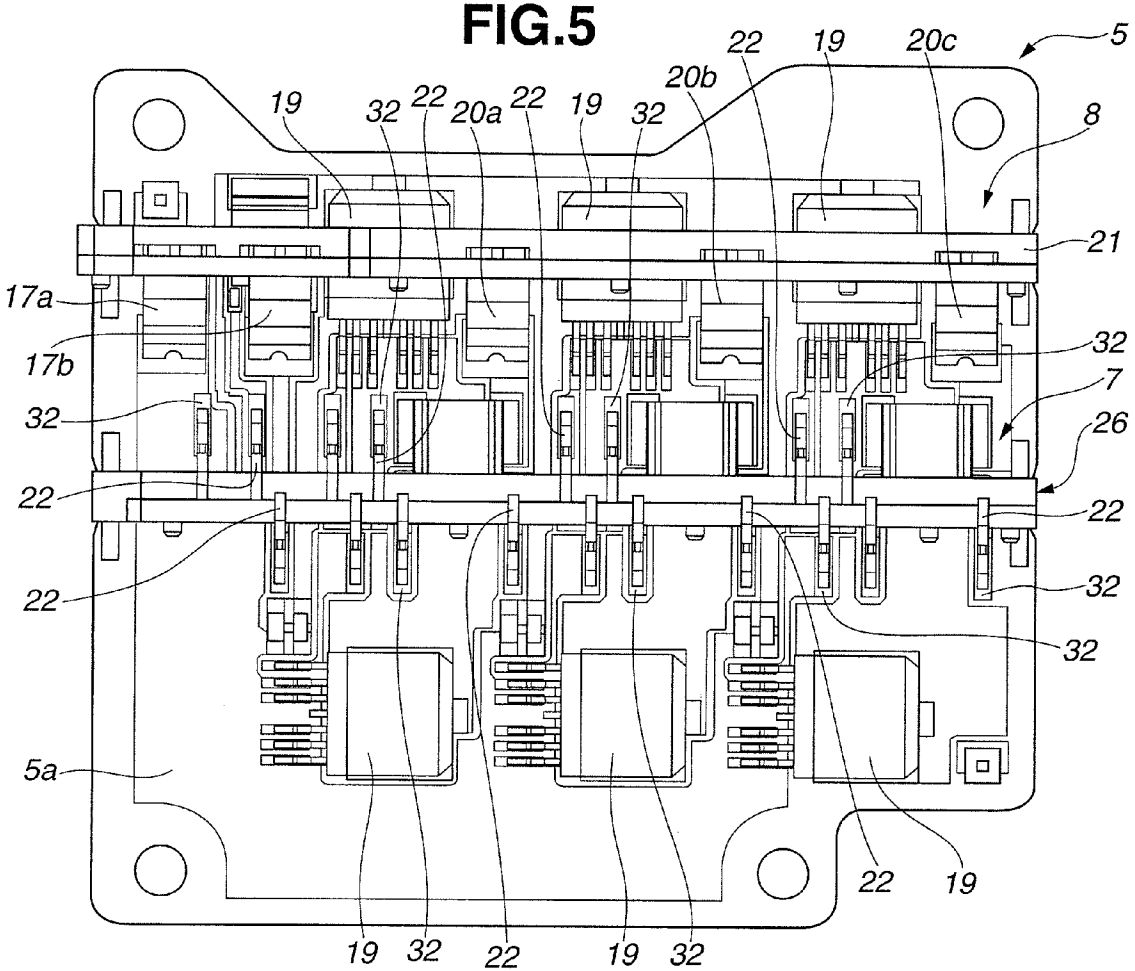
FIG. 5 is a plan view of the power module shown in FIG. 4.

FIGS. 4 and 5 show power module 5 solely in the mounting state in which signal-system lead frame 7, power-system lead frame 8 and switching elements 19 are mounted on part mounting surface 5*a*. FIG. 4 is a perspective view of power module 5, and FIG. 5 is a plan view of power module 5.

Specifically, as shown in FIGS. 4 and 5, power module 5 has a generally rectangular shape in plan view. As shown in FIGS. 4 and 5, three switching elements 19 are arranged on one of opposite long-side peripheral end portions of rectangular part mounting surface 5*a* along a direction of the long-side of rectangular part mounting surface 5*a*. Further, three switching elements 19 and power-system lead frame 8 are arranged on the other of the opposite long-side peripheral end portions of rectangular part mounting surface 5*a* along the direction of the long-side of rectangular part mounting surface 5*a*.

Signal-system lead frame 7 is arranged at a substantially middle portion of part mounting surface 5*a* of power module 5 between the opposite long-side peripheral end portions of rectangular part mounting surface 5*a* along the long-side direction of rectangular part mounting surface 5*a*. Signal-system lead frame 7 includes the plurality of signal-system terminal pins 22 through which control module 6 and power module 5 are electrically connected with each other, and signal-system terminal pin holder 26 that holds signal-system terminal pins 22 in such a state that signal-system terminal pins 22 are spaced from each other and aligned in a row with each other in the long-side direction of rectangular part mounting surface 5*a* of power module 5. Respective signal-system terminal pins 22 correspond to a terminal pin according to the present invention, and signal-system terminal pin holder 26 corresponds to a terminal pin holding member according to the present invention.

Figure 6:
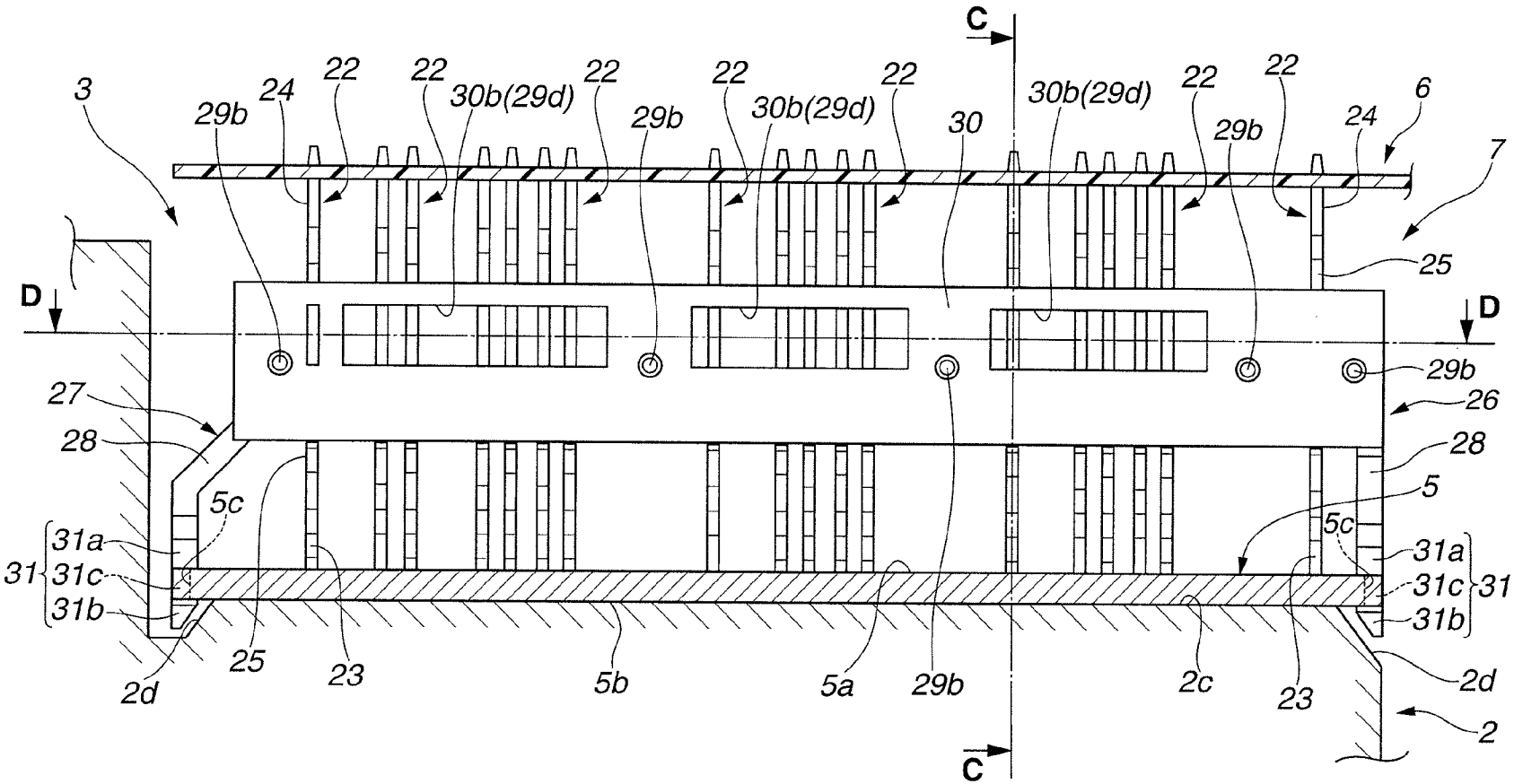
FIG. 6 is a cross section of the electronic control device, taken along line B-B shown in FIG. 3.
Figure 7:
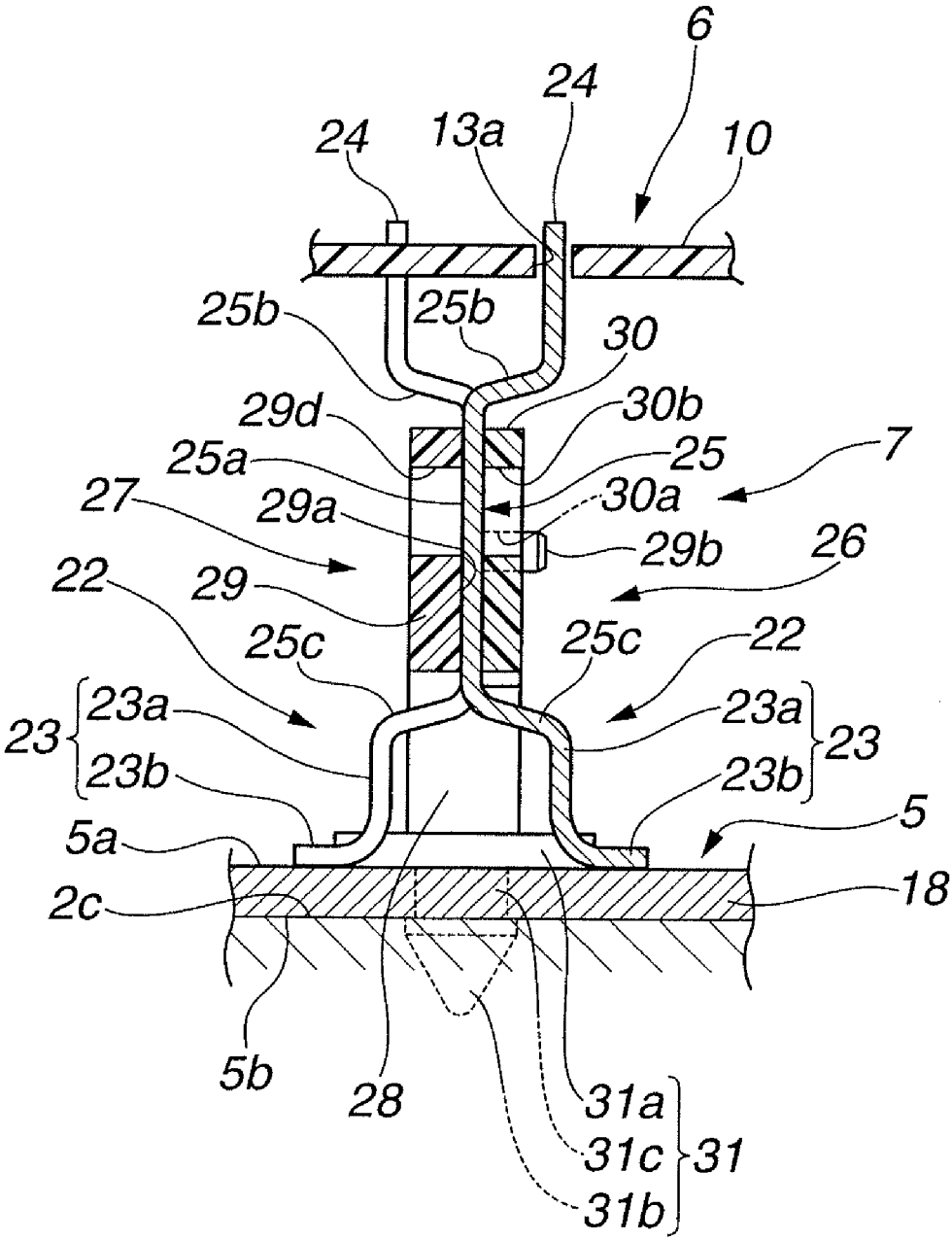
FIG. 7 is a cross section of the electronic control device, taken along line C-C shown in FIG. 6.
Figure 8:
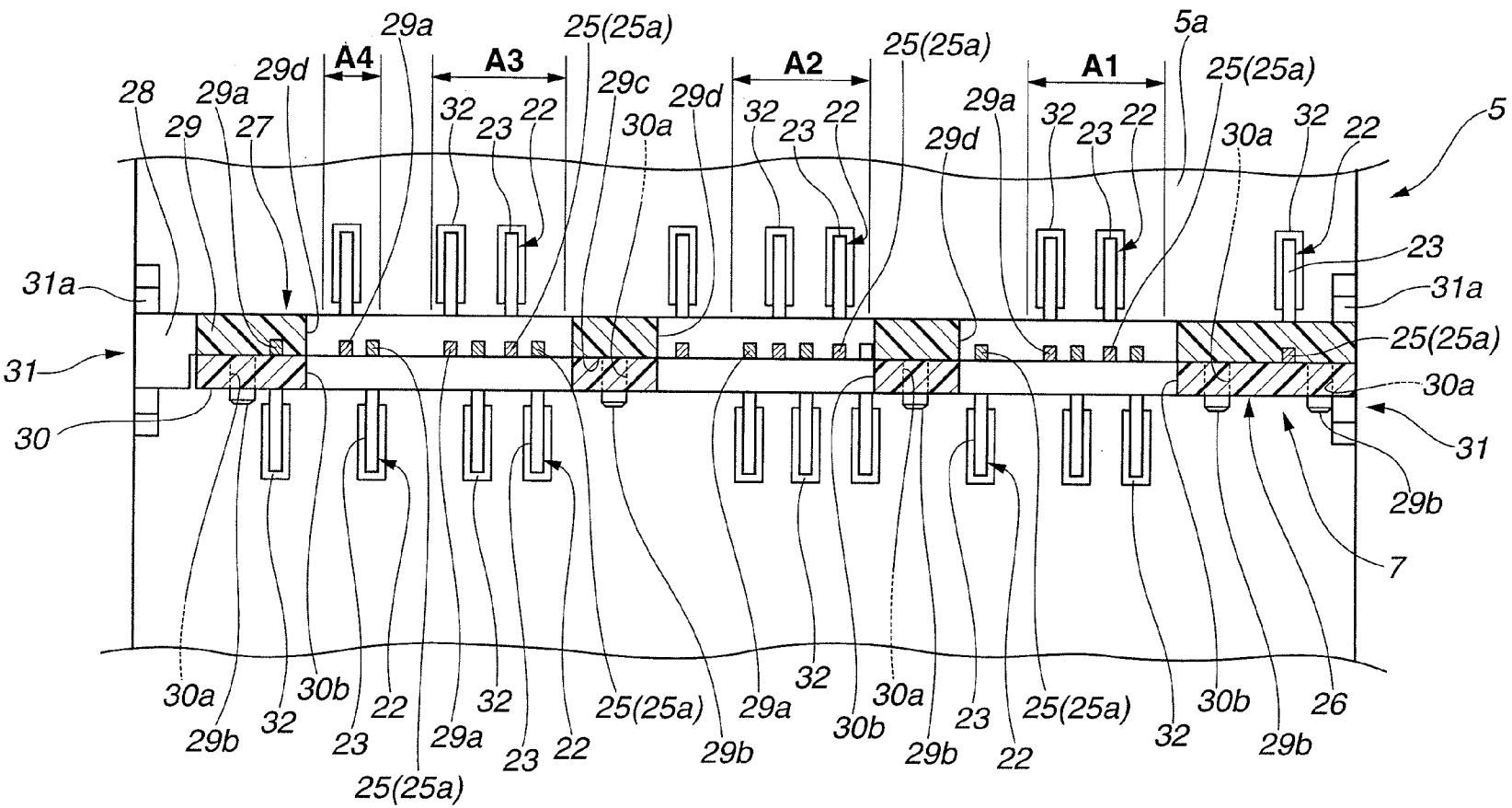
FIG. 8 is a cross section of the electronic control device, taken along line D-D shown in FIG. 6.

FIGS. 6-8 show a detailed construction of signal-system lead frame 7. FIG. 6 is a cross section of signal-system lead frame 7, taken along line B-B shown in FIG. 3. FIG. 7 is a cross section of signal-system lead frame 7, taken along line C-C shown in FIG. 6. FIG. 8 is a cross section of signal-system lead frame 7, taken along line D-D shown in FIG. 6.

As shown in FIGS. 6-8, respective signal-system terminal pins 22 have a bent shape formed by pressing a wire rod that is made of a conductive metal material such as copper alloy and has a generally rectangular shape in section. Signal-system terminal pins 22 are identical in shape. Specifically, as shown in FIG. 7, each of signal-system terminal pins 22 includes generally L-shaped power module side connecting portion 23 as a first circuit side connecting portion, linearly extending control module side connecting portion 24 as a second circuit side connecting portion, and generally C-shaped bent portion 25 disposed between power module side connecting portion 23 and control module side connecting portion 24. Power module side connecting portion 23 includes raised portion 23*a* substantially perpendicularly raised up from part mounting surface 5*a* of power module 5, and contact portion 23*b* extending substantially parallel to power module 5 and coming into contact with part mounting surface 5*a* of power module 5. Control module side connecting portion 24 is located on an imaginary extension line of raised portion 23*a*. Bent portion 25 is bent to project in a direction parallel to power module 5 toward the opposite side of contact portion 23*b*. Bent portion 25 includes intermediate connecting portion 25*a* extending in an overlapping direction in which power module 5 and control module 6 overlap with each other, and a pair of horizontal portions 25*b*, 25*c* extending from opposite ends of intermediate connecting portion 25*a* in a direction substantially horizontal or parallel to power module 5. Horizontal portion 25*b* is connected with control module side connecting portion 24, and horizontal portion 25*c* is connected with raised portion 23*a* of power module side connecting portion 23.

On the other hand, as shown in FIGS. 6-8, signal-system terminal pin holder 26 includes holder body 27 and flat holder plate 30 overlapped with holder body 27. Holder body 27 includes flat plate-shaped terminal pin holding portion 29 extending in the alignment direction of signal-system terminal pins 22 between power module 5 and control module 6 and holding signal-system terminal pins 22, and a pair of legs 28 extending from both longitudinal ends of terminal pin holding portion 29 toward power module 5. Each of legs 28 has one end fixed to an end of power module 5 which corresponds to each of opposite short-side peripheral ends of part mounting surface 5*a*. The other end portion of each of legs 28 is connected with each other through terminal pin holding portion 29. As shown in FIG. 8, holder plate 30 is overlaid on terminal pin holding surface 29*c* of terminal pin holding portion 29 which extends perpendicular to part mounting surface 5*a* of power module 5. Holder body 27 and holder plate 30 both are made of non-conductive resin. In FIGS. 6-8, reference numerals 29*d*, 30*b* denote windows formed on holder body 27 and holder plate 30, respectively.

As shown in FIG. 8, a plurality of terminal pin fitting grooves 29*a* and a plurality of cylindrical projections 29*b* are formed on terminal pin holding surface 29*c* of terminal pin holding portion 29. Terminal pin fitting grooves 29*a* are arranged in a longitudinal direction of terminal pin holding portion 29 at predetermined intervals. Each of terminal pin fitting grooves 29*a* has a generally U-shaped section and extends in the overlapping direction of power module 5 and control module 6, that is, in a direction perpendicular to part mounting surface 5*a* of power module 5. Projections 29*b* are arranged in the longitudinal direction of terminal pin holding portion 29 in a spaced relation to each other, and inserted into a plurality of mounting holes 30*a* extending through holder plate 30, respectively.

Intermediate connecting portion 25*a* of bent portion 25 of each of signal-system terminal pins 22 is fitted into each of terminal pin fitting grooves 29*a* of terminal pin holding portion 29, so that signal-system terminal pin 22 is restrained from pivoting about intermediate connecting portion 25*a*. In this state, terminal pin holding portion 29 and holder plate 30 are overlaid on each other such that projections 29*b* are inserted into mounting holes 30*a*. While holding terminal pin holding portion 29 and holder plate 30 in the overlaid state, holder plate 30 is fixed to terminal pin holding portion 29 by subjecting projections 29*b* to thermal caulking. As a result, respective signal-system terminal pins 22 are held in a mounting attitude relative to power module 5 on signal-system terminal pin holder 26.

As shown in FIGS. 6 and 7, signal-system terminal pin holder 26 is mounted to power module 5 through fixing portion 31 formed at the one end portion of each leg 28 of holder body 27 by so-called snap fit. Fixing portion 31 includes flange 31*a* seated on part mounting surface 5*a* of power module 5, pawl 31*b* that is engaged with cooling surface 5*b* of power module 5 to thereby prevent signal-system terminal pin holder 26 from being released from power module 5, and neck 31*c* that is disposed between flange 31*a* and pawl 31*b* and has a reduced size smaller than flange 31*a* and pawl 31*b*. Neck 31*c* is fitted into recessed portion 5*c* (see FIG. 2) formed on each of opposite ends of power module 5 which correspond to the opposite short-side peripheral ends of part mounting surface 5*a*. An outer periphery of recessed portion 5*c* is received between flange 31*a* and pawl 31*b*. By thus mounting signal-system terminal pin holder 26 to power module 5, relative positioning of signal-system lead frame 7 and power module 5 can be performed such that power module side connecting portions 23 of signal-system terminal pins 22 are contacted with pads 32 formed on power module 5, respectively. In FIG. 6, reference numeral 2*d* denotes a recessed portion of housing 2 which serves for preventing interference with pawl 31*b* of fixing portion 31.

When power module 5 and control module 6 are electrically connected to each other through signal-system terminal pins 22 aligned in a row, it is desirable to reduce the intervals between adjacent signal-system terminal pins 22 in view of downsizing electronic control device 100 in the alignment direction of signal-system terminal pins 22. As generally known, there are provided pads 32 for connecting respective signal-system terminal pins 22 to power module 5, and lands (not shown) that are formed in the vicinity of through-holes 13*a* for connecting respective signal-system terminal pins 22 to control module 6. The lands are fabricated by subjecting a metal foil to pressing or etching. In view of the fabricating method, it is necessary to ensure certain intervals between respective pads 32 and certain intervals between respective through-holes 13*a* in the alignment direction of signal-system terminal pins 22. Therefore, there is a limitation to reduce the intervals between respective pads 32 and the intervals between respective through-holes 13*a* in the alignment direction of signal-system terminal pins 22. Further, from the viewpoint of suppressing occurrence of so-called soldering bridge, it is preferred to ensure the certain intervals between respective pads 32 and the certain intervals between respective through-holes 13*a* in the alignment direction of signal-system terminal pins 22.

For this reason, in a case where signal-system terminal pins connecting the power module and the control module with each other are merely arranged in a row as described in the above conventional art, upsizing of the power module and the control module is required in accordance with the increase in number of the signal-system terminal pins.

Therefore, in the first embodiment according to the present invention, as seen from FIGS. 4 and 8, in terminal-pin dense regions A1-A4 of signal-system lead frame 7 in which the intervals between signal-system terminal pins 22 adjacent to each other are minimum, the adjacent signal-system terminal pins 22 are arranged to have such a mounting attitude that the adjacent signal-system terminal pins 22 are angularly displaced from each other by 180 degrees in a direction of rotation about intermediate connecting portion 25*a* (see FIG. 7). That is, in the respective terminal-pin dense regions A1-A4, signal-system terminal pin 22 having connecting portions 23, 24 located on one side of intermediate connecting portion 25*a* in the direction perpendicular to the alignment direction of signal-system terminal pins 22, and signal-system terminal pin 22 having connecting portions 23, 24 located on the other side of intermediate connecting portion 25*a* in the direction perpendicular to the alignment direction of signal-system terminal pins 22 are alternately arranged in the alignment direction of signal-system terminal pins 22. With this arrangement, in the respective terminal-pin dense regions A1-A4, power module side connecting portions 23 of adjacent signal-system terminal pins 22 are located offset from each other in the direction perpendicular to the alignment direction of signal-system terminal pins 22, and control module side connecting portions 24 of the adjacent signal-system terminal pin 22 are located offset from each other in the direction perpendicular to the alignment direction of signal-system terminal pins 22. Further, power module side connecting portion 23 and control module side connecting portion 24 of respective signal-system terminal pins 22 are arranged to avoid overlapping with signal-system terminal pin holder 26 in the direction perpendicular to part mounting surface 5*a* of power module 5.

The term "offset" means that power module side connecting portion 23 and control module side connecting portion 24 of one of the adjacent signal-system terminal pins 22 are displaced with respect to power module side connecting portion 23 and control module side connecting portion 24 of the other of the adjacent signal-system terminal pins 22 in the direction perpendicular to the alignment direction of signal-system terminal pins 22. In this embodiment, an amount of the offset (or an amount of the displacement) is set to such an extent that the adjacent power module side connecting portions 23 are prevented from overlapping with each other in the alignment direction of signal-system terminal pins 22.

In other words, one of a pair of terminal pins 22 adjacent to each other in the respective terminal-pin dense regions A1-A4 is mounted to signal-system terminal pin holder 26 in such an attitude that the pair of horizontal portions 25*b*, 25*c* of bent portion 25 are oriented toward holder plate 30 as shown in FIG. 7. The other of the pair of terminal pins 22 is mounted to signal-system terminal pin holder 26 in such an attitude that horizontal portions 25*b*, 25*c* are oriented toward terminal pin holding portion 29 as shown in FIG. 7. Further, in other words, one of the pair of terminal pins 22 adjacent to each other in the respective terminal-pin dense regions A1-A4 is bent such that connecting portions 23, 24 are offset with respect to connecting portions 23, 24 of the other of the pair of adjacent terminal pins 22 in the direction perpendicular to the alignment direction of signal-system terminal pins 22, respectively.

In thus constructed electronic control device 100, intermediate connecting portions 25*a* of signal-system terminal pins 22 which are held by signal-system terminal pin holder 26 are aligned in a row in the alignment direction of signal-system terminal pins 22, and connecting portions 23, 24 of signal-system terminal pins 22 are respectively aligned in two rows between which signal-system terminal pin holder 26 is disposed. That is, pads 32 of power module 5 and through-holes 13*a* of control module 6 can be respectively formed in two rows spaced apart at predetermined intervals from each other in the direction perpendicular to the alignment direction of signal-system terminal pins 22.

An operation of connecting thus constructed signal-system lead frame 7 to power module 5 and control module 6 is now explained. First, signal-system lead frame 7 is mounted to power module 5 before mounting power module 5 onto housing 2. Specifically, power module side connecting portions 23 of signal-system terminal pins 22 are respectively brought into contact with pads 32 of power module 5 by fixing signal-system terminal pin holder 26 to power module 5 as explained above. In this state, power module side connecting portions 23 of signal-system terminal pins 22 are connected and fixed to pads 32 of power module 5 by so-called reflow soldering.

Subsequent to thus mounting signal-system lead frame 7 to power module 5, power module 5 and conductive module 9 are fixed to housing 2. Then, power supply terminals 16*a*, 16*b* of conductive module 9 and power source terminal pins 17*a*, 17*b* of signal-system lead frame 7 are electrically connected with each other by welding. In this state, control module side connecting portions 24 of signal-system terminal pins 22 are inserted into through-holes 13*a* of control module 6, thereby fixing control module 6 to housing 2. Subsequently, control module side connecting portions 24 are connected to through-holes 13*a* by so-called flow soldering. As a result, power module 5 and control module 6 are electrically connected to each other through signal-system lead frame 7.

In the above construction of electronic control device 100 of this embodiment, through-holes 13*a* of control module 6 and pads 32 of power module 5 can be arranged in two rows, respectively. Therefore, the intervals between adjacent signal-system terminal pins 22 in the alignment direction of signal-system terminal pins 22 can be reduced, so that electronic control device 100 can be downsized in the alignment direction of signal-system terminal pins 22. As a result, installability of electronic control device 100 to the vehicle can be remarkably enhanced.

Further, intermediate connecting portions 25*a* of signal-system terminal pins 22 can be aligned in a row, and signal-system terminal pins 22 can be held by signal-system terminal pin holder 26 as a single member. With this construction, signal-system terminal pins 22 can be simultaneously brought into contact with pads 32 of power module 5 by simply mounting signal-system terminal pin holder 26 to power module 5. An efficiency of the operation of mounting signal-system lead frame 7 to power module 5 can be remarkably enhanced.

Further, since signal-system terminal pins 22 are identical in shape, the use of only one kind of signal-system terminal pins 22 is enough to connect power module 5 and control module 6 with each other through signal-system terminal pins 22. Accordingly, fabricating costs of electronic control device 100 can be advantageously reduced.

Further, even in a case where there occurs deflection and deformation in power module 5 or control module 6 due to vibration and temperature change of electronic control device 100 during the vehicle travelling, signal-system terminal pins 22 having bent portion 25 can absorb the deflection and deformation owing to elasticity thereof. Further, since power module side connecting portions 23 and control module side connecting portions 24 of signal-system terminal pins 22 are arranged in two rows, respectively, it is possible to disperse a stress acting on both power module side connecting portions 23 and control module side connecting portions 24. As a result, as compared to the electronic control device of the above conventional art in which the power module side connecting portions and the control module side connecting portions of the signal-system terminal pins are arranged in a row, a stress acting on the soldered portions of respective signal-system terminal pins 22 can be reduced to thereby enhance reliability of the electrical connection between power module 5 and control module 6 through signal-system terminal pins 22.

Furthermore, power module side connecting portions 23 of signal-system terminal pins 22 are arranged so as to avoid overlapping with signal-system terminal pin holder 26 in the direction perpendicular to part mounting surface 5*a* of power module 5. With this arrangement, after signal-system lead frame 7 is mounted to power module 5, by using an image of part mounting surface 5*a* of power module 5 which is photographed from the direction perpendicular to part mounting surface 5*a*, it is possible to readily inspect a condition of the soldering connection between signal-system terminal pins 22 and pads 32.

Although in electronic control device 100 according to the first embodiment as described above, respective signal-system terminal pins 22 have a same shape, signal-system terminal pins having shapes different from each other may be used. Specifically, in the terminal-pin dense regions A1-A4, signal-system terminal pins having the same shape as that of respective signal-system terminal pins 22, and signal-system terminal pins having a so-called straight linear shape may be alternately arranged. In such a case, intermediate connecting portions of the signal-system terminal pins which are held by the signal-system terminal pin holder can be arranged in a row, and the connecting portions of the signal-system terminal pins which are connected with power module 5 and the connecting portions of the signal-system terminal pins which are connected with control module 6 can be arranged in two rows, respectively.

Figure 9:
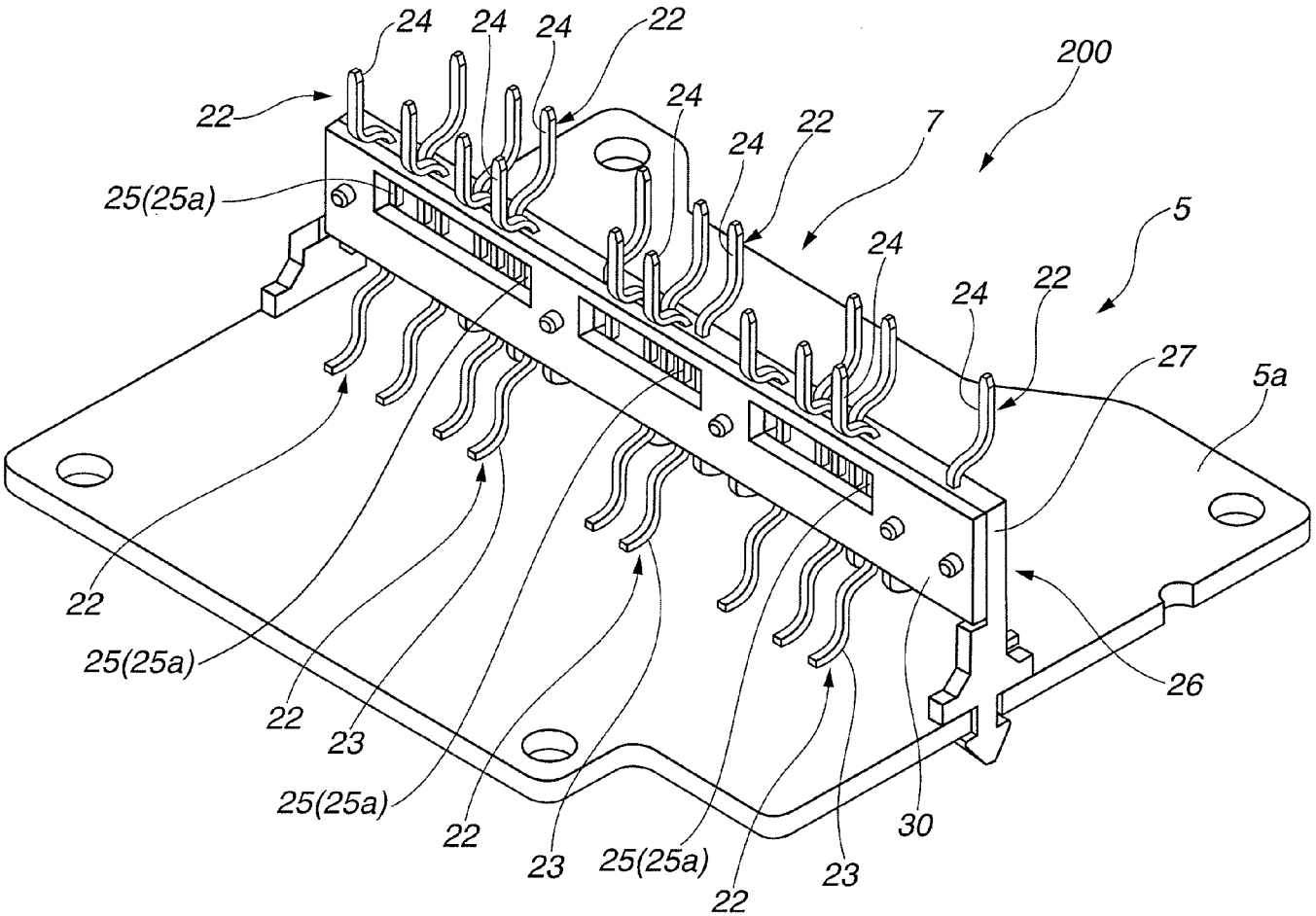
FIG. 9 is a perspective view of an electronic control device according to a second embodiment of the present invention, showing a power module to which a signal-system lead frame is mounted.

FIG. 9 is a perspective view of an electronic control device according to a second embodiment of the present invention, showing a power module to which a signal-system lead frame is mounted. In FIG. 9, for the sake of simple illustration, power-system lead frame 8, respective switching elements 9, etc. are omitted.

As shown in FIG. 9, in electronic control device 200 according to the second embodiment, signal-system terminal pin 22 having connecting portions 23, 24 located on one side of intermediate connecting portion 25*a* in the direction perpendicular to the alignment direction of signal-system terminal pins 22 (i.e., the alignment direction of intermediate connecting portion 25*a*), and signal-system terminal pin 22 having connecting portions 23, 24 located on the other side of intermediate connecting portion 25*a* in the direction perpendicular to the alignment direction of signal-system terminal pins 22 are alternately arranged in the alignment direction of signal-system terminal pins 22 over an entire region of signal-system lead frame 7 in a longitudinal direction thereof. Further, in electronic control device 200 according to the second embodiment, the number of signal-system terminal pin 22 having connecting portions 23, 24 located on one side of intermediate connecting portion 25*a* in the direction perpendicular to the alignment direction of signal-system terminal pins 22, and the number of signal-system terminal pin 22 having connecting portions 23, 24 located on the other side of intermediate connecting portion 25*a* in the direction perpendicular to the alignment direction of signal-system terminal pins 22 are set to be identical to each other. Other parts of electronic control device 200 are similar to those of electronic control device 100 according to the first embodiment.

Electronic control device 200 according to the second embodiment can attain substantially the same effects as electronic control device 100 according to the first embodiment. Further, even in a case where there occurs deflection and deformation in power module 5 or control module 6 due to vibration and temperature change of electronic control device 200 during the vehicle travelling, a stress acting on the soldered portions of respective signal-system terminal pins 22 can be more effectively dispersed. In addition, electronic control device 200 can be more advantageously downsized in the alignment direction of signal-system terminal pins 22.

As explained above, in view of the fabricating method, it is necessary to ensure certain intervals between respective pads 32 of power module 5 and certain intervals between respective through-holes 13*a* in the alignment direction of signal-system terminal pins 22. It is generally known that a minimum interval to be provided between the adjacent lands formed around respective pads 32 or through-holes 13*a* becomes larger in proportion to a thickness of a metal foil forming a conductive pattern thereon. The minimum interval between through-holes 13*a* of control module 6 which has a conductive pattern formed using a metal foil thinner than that for power module 5 can be reduced as compared to the minimum interval between adjacent pads 32 of power module 5. Therefore, there is provided an electronic control device according to a third embodiment as shown in FIG. 10 and FIG. 11, in which the control module side connecting portion of the respective signal-system terminal pins and the intermediate connecting portion of the respective signal-system terminal pins are formed into a straight linear portion, and coaxially aligned with each other.

Figure 10:
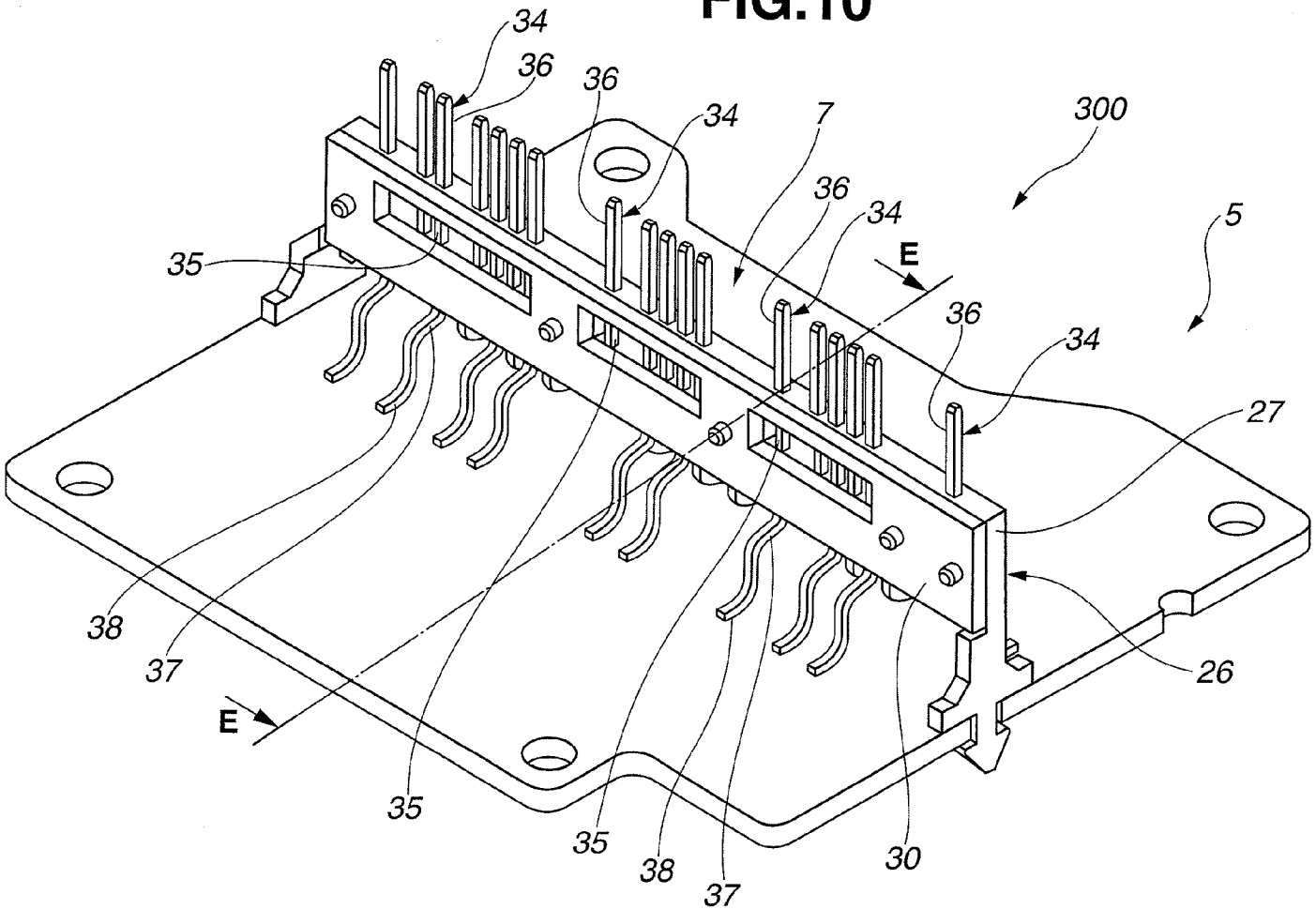
FIG. 10 is a perspective view of an electronic control device according to a third embodiment of the present invention, showing a power module to which a signal-system lead frame is mounted.
Figure 11:
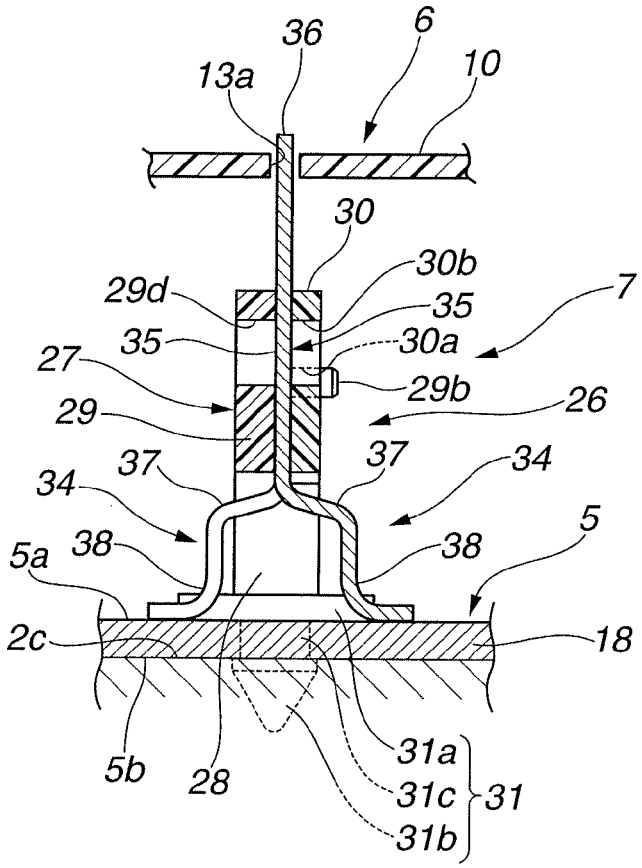
FIG. 11 is a cross section of the electronic control device, taken along line E-E shown in FIG. 10.

More specifically, as seen from FIGS. 10 and 11, electronic control device 300 according to the third embodiment includes a plurality of signal-system terminal pins 34 arranged in a row between power module 5 and control module 6. As shown in FIG. 11, each of signal-system terminal pins 34 includes intermediate connecting portion 35 extending in the overlapping direction of power module 5 and control module 6, control module side connecting portion 36 extending from one end of intermediate connecting portion 35 toward control module 6, horizontal portion 37 extending from the other end of intermediate connecting portion 35 in a direction substantially parallel to power module 5, and power module side connecting portion 38 extending from an end of horizontal portion 37. Specifically, control module side connecting portion 36 is disposed coaxially with intermediate connecting portion 35 to extend linearly therewith. Horizontal portion 37 extends from the other end of intermediate connecting portion 35 which is located on the side of power module 5. Power module side connecting portion 38 extends from the end of horizontal portion 37 which is located on an opposite side of intermediate connecting portion 35, toward power module 5, and is then bent at a substantially right angle in such a direction as to be spaced from intermediate connecting portion 35. Power module side connecting portion 38 thus has a generally L-shape. Power module side connecting portion 38 serves as a first circuit side connecting portion connected to power module 5, and control module side connecting portion 36 serves as a second circuit side connecting portion connected to control module 6 through through-hole 13*a*.

Signal-system terminal pin 34 having power module side connecting portion 38 located on one side of intermediate connecting portion 35 in a direction perpendicular to the alignment direction of signal-system terminal pins 34, and signal-system terminal pin 34 having power module side connecting portion 38 located on the other side of intermediate connecting portion 35 in the direction perpendicular to the alignment direction of signal-system terminal pin 34, are alternately arranged over an entire region in the longitudinal direction of signal-system lead frame 7. Other parts of electronic control device 300 are similar to those of electronic control device 200 according to the second embodiment.

Electronic control device 300 according to the third embodiment can attain same effects as those of electronic control device 200 according to the second embodiment. In addition, the shape of respective signal-system terminal pins 34 can be simplified to thereby facilitate forming of signal-system terminal pins 34.

In electronic control device 100 according to the first embodiment to electronic control device 300 according to the third embodiment, signal-system terminal pin holder 26 is fixed to power module by so-called snap fit. However, the fixing construction of signal-system terminal pin holder 26 relative to power module 5 is not limited to the snap fit. A fixing construction of an electronic control device according to a fourth embodiment as shown in FIG. 12 can also be used.

Figure 12:
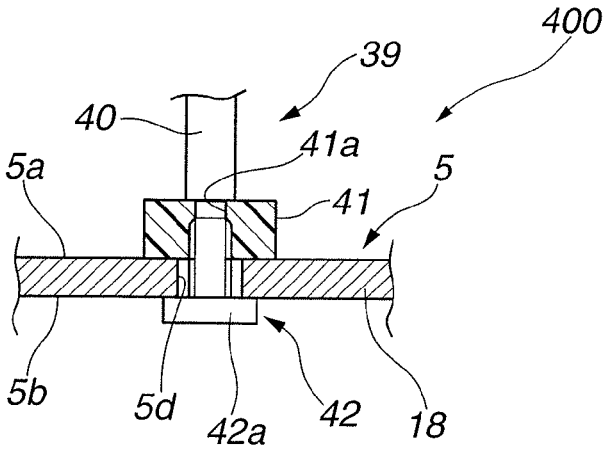
FIG. 12 is a fragmentary view of an electronic device according to a fourth embodiment of the present invention, showing a fixing structure for fixing a signal-system terminal pin holder to a power module.

FIG. 12 shows the fixing construction of electronic control device 400 according to the fourth embodiment, in which signal-system terminal pin holder 39 is fixed to power module 5 by means of screw members. In FIG. 12, there is shown only one of a pair of legs 40 of signal-system terminal pin holder 39, but the other of legs 40 is similarly formed on signal-system terminal pin holder 39. As shown in FIG. 12, each of legs 40 of signal-system terminal pin holder 39 is formed with plate-shaped mounting base 41 seated on part mounting surface 5*a* of power module 5. Mounting base 41 has through-hole 41*a* extending between one surface thereof contacted with part mounting surface 5*a* of power module 5 and the other surface thereof. Tapping screw 42 is inserted into mounting hole 5*d* of power module 5 from the side of cooling surface 5*b* of power module 5 and screwed into through-hole 41*a* of mounting base 41. That is, signal-system terminal pin holder 39 is fixed to power module 5 by tapping screw 42 which extends through mounting hole 5*d* and is screwed into through-hole 41*a*.

In electronic control device 400 according to the fourth embodiment, head 42*a* of tapping screw 42 is seated not on mounting base 41 but on cooling surface 5*b* of power module 5. Therefore, as compared to the case in which the head of the tapping screw is seated on mounting base 41, a contact area of mounting base 41 with part mounting surface 5*a* of power module 5 can be reduced. As a result, power module 5 can be advantageously downsized. Further, since it is not necessary to form a female screw portion in metal plate 18 of power module 5, thereby serving for reducing a fabricating cost of electronic control device 400.

This application is based on a prior Japanese Patent Application No. 2010-211979 filed on Sep. 22, 2010. The entire contents of the Japanese Patent Application No. 2010-211979 are hereby incorporated by reference.

Although the invention has been described above by reference to certain embodiments of the invention, the invention is not limited to the embodiments described above. Further variations of the embodiments described above will occur to those skilled in the art in light of the above teachings. The scope of the invention is defined with reference to the following claims.

What is claimed is:

1. An electronic control device comprising:

a first circuit board;

a second circuit board overlapping with the first circuit board with a space therebetween; and a plurality of terminal pins through which the first circuit board and the second circuit board are electrically connected with each other;

wherein each of the plurality of terminal pins comprises a first circuit board side connecting portion connected to the first circuit board, a second circuit board side connecting portion connected to the second circuit board, and an intermediate connecting portion disposed between the first circuit board side connecting portion and the second circuit board side connecting portion, the intermediate connecting portion extending in an overlapping direction in which the first circuit board and the second circuit board overlap with each other, the intermediate connecting portions of the plurality of terminal pins are disposed between the first circuit board and the second circuit board and aligned in a row along a predetermined alignment direction, and the plurality of terminal pins at least partially comprise adjacent two terminal pins which are formed into a bent shape such that the first circuit board side connecting portion of one of the adjacent two terminal pins is offset relative to the first circuit board side connecting portion of the other of the adjacent two terminal pins in a direction perpendicular to the predetermined alignment direction, wherein the first circuit board side connecting portion comprises a contact portion extending substantially parallel to the first circuit board and contacted with the first circuit board, and a raised portion substantially perpendicularly raised up relative to the first circuit board, and wherein each of the plurality of terminal pins further comprises a bent portion bent to project toward an opposite side of the contact portion of the first circuit board side connecting portion, the bent portion comprising a portion that extends from one end of the intermediate connecting portion in a direction substantially parallel to the first circuit board and is connected with the raised portion of the first circuit board side connecting portion, and the intermediate connecting portion is located in the bent portion.

2. The electronic control device as claimed in claim 1, wherein each of the plurality of terminal pins is formed into a bent shape such that the first circuit board side connecting portion is offset relative to the intermediate connecting portion in a direction perpendicular to the predetermined alignment direction, the plurality of terminal pins comprise a first group of the terminal pins mounted onto the first circuit board in a mounting attitude in which each of the terminal pins is positioned in a direction of rotation about the intermediate connecting portion such that the first circuit board side connecting portion is disposed on one side of the intermediate connecting portion in the direction perpendicular to the predetermined alignment direction, and a second group of the terminal pins mounted onto the first circuit board in a mounting attitude in which each of the terminal pins is positioned in the direction of rotation about the intermediate connecting portion such that the first circuit board side connecting portion is disposed on the other side of the intermediate connecting portion in the direction perpendicular to the predetermined alignment direction, and the first circuit board side connecting portions of the plurality of terminal pins are arranged in two rows in the predetermined alignment direction.

3. The electronic control device as claimed in claim 2, wherein the plurality of terminal pins are identical in shape to each other.

4. The electronic control device as claimed in claim 2, wherein each of the plurality of terminal pins is formed into a bent shape such that the second circuit board side connecting portion is offset relative to the intermediate connecting portion in the direction perpendicular to the predetermined alignment direction, and the second circuit board side connecting portions of the plurality of terminal pins are arranged in two rows in the predetermined alignment direction.

5. The electronic control device as claimed in claim 1, further comprising a terminal pin holder that holds the intermediate connecting portions of the plurality of terminal pins in a state aligned in a row and holds the plurality of terminal pins in a mounting attitude relative to the first circuit board.

6. The electronic control device as claimed in claim 5, wherein the terminal pin holder comprises a terminal pin holding portion that extends in the alignment direction of the plurality of terminal pins between the first circuit board and the second first circuit board and holds the plurality of terminal pins, and a pair of legs extending from both longitudinal ends of the terminal pin holder toward the first circuit board, the first circuit module has a part mounting surface on which the plurality of terminal pins are mounted, and the terminal pin holder is fixed to the first circuit board through screw members inserted from a surface of the first circuit module which is located on an opposite side of the part mounting surface, into the pair of legs.

7. The electronic control device as claimed in claim 2, further comprising a terminal pin holder that holds the intermediate connecting portions of the plurality of terminal pins in a state aligned in a row and holds the plurality of terminal pins in a mounting attitude relative to the first circuit board, wherein the first group of the terminal pins and the second group of the terminal pins are alternately arranged over an entire region of the terminal pin holder in a longitudinal direction of the terminal pin holder.

8. The electronic control device as claimed in claim 2, wherein the second circuit board side connecting portion is disposed coaxially with the intermediate connecting portion to extend linearly therewith.

9. The electronic control device as claimed in claim 7, wherein the first group of the terminal pins and the second group of the terminal pins are identical in number of the terminal pins to each other.

* * * * *